US005160106A

United States Patent [19]

Monick

[11] Patent Number: 5,160,106

[45] Date of Patent: Nov. 3, 1992

[54] ADAPTOR FOR ANESTHESIA EQUIPMENT

[76] Inventor: Michelle M. Monick, Wesleyan Corners Apt. 65, 1800 Wesleyan Dr., Macon, Ga. 31210

[21] Appl. No.: 821,562

[22] Filed: Jan. 16, 1992

[51] Int. Cl.[5] ..... A47B 96/06

[52] U.S. Cl. ..... 248/231.7; 248/74.1

[58] Field of Search ..... 248/231.7, 314, 231.8, 248/51, 74.1; 604/322, 323; 5/658, 503.1

[56] References Cited

U.S. PATENT DOCUMENTS

| | | | |
|---|---|---|---|
| 2,238,258 | 4/1941 | Flocker | 248/51 |
| 2,459,246 | 1/1949 | Sinclair | 5/503.1 X |
| 2,606,555 | 8/1952 | Solomon | 604/323 |
| 3,899,149 | 8/1975 | Schneider | 5/658 X |
| 4,417,710 | 11/1983 | Adair | 248/51 |
| 4,502,653 | 3/1985 | Curtis | 248/55 |
| 4,768,241 | 9/1988 | Beney | 5/503.1 X |
| 5,023,961 | 6/1991 | Alonso | 248/231.7 X |

*Primary Examiner*—J. Franklin Foss

*Attorney, Agent, or Firm*—Woodcock, Washburn, Kurtz, Mackiewicz & Norris

[57] ABSTRACT

An adaptor for supporting a suction catheter for use with a patient on an operating room table in connection with an anesthesia machine. The adaptor includes anti-friction means for engaging the suction tube attached to the catheter.

10 Claims, 1 Drawing Sheet

FIG. 1
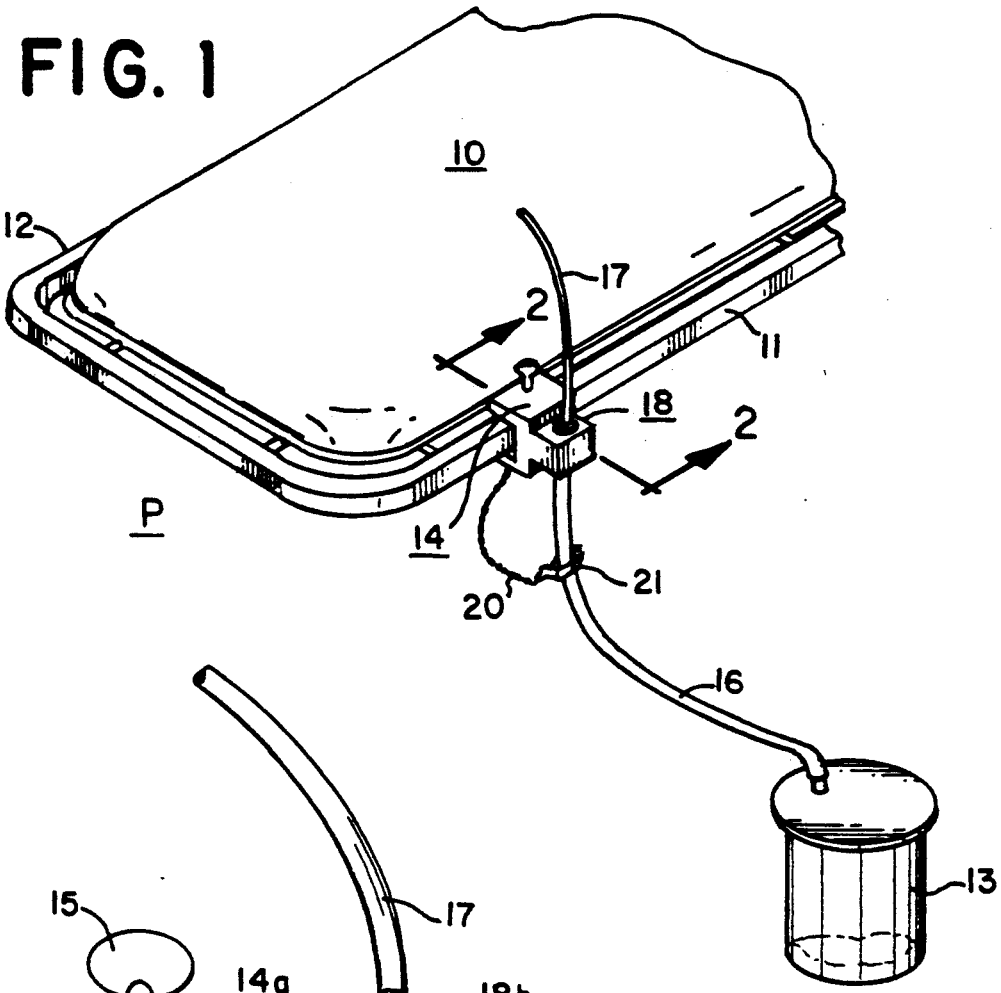
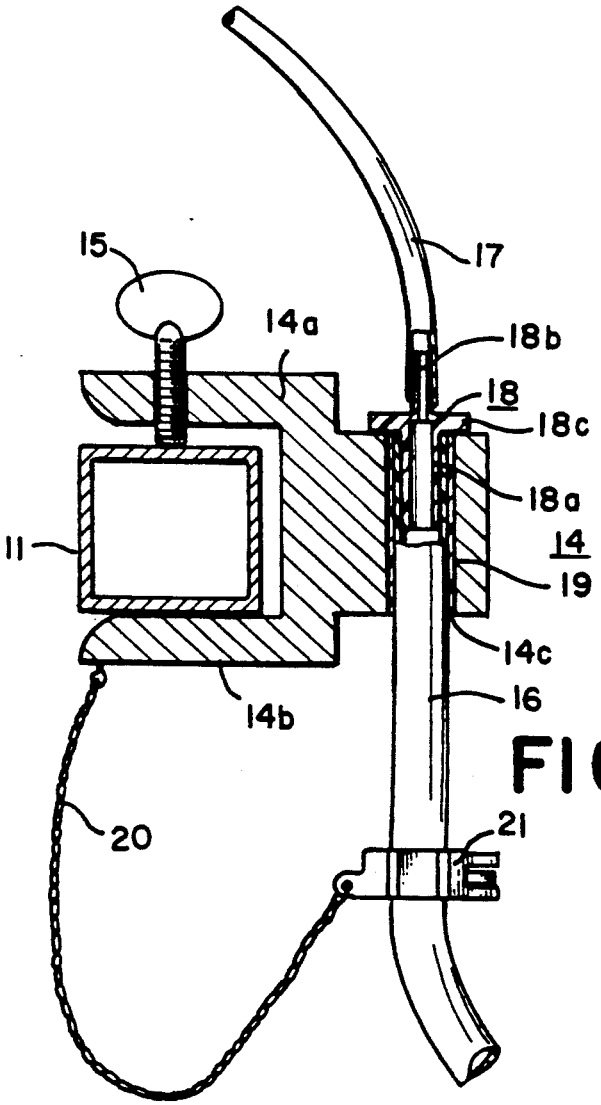
FIG. 2

ADAPTOR FOR ANESTHESIA EQUIPMENT

BACKGROUND OF THE INVENTION

The present invention relates to administering general anesthesia and particularly to an adaptor for a suction catheter for use with a patient on an operating room table in connection with an anesthesia machine.

In administering general anesthesia the patient is asleep with an oral or nasal breathing tube placed into the trachea. When the patient is emerging (awakening) from general anesthesia, the patient's mouth and the pharynx needs to be suctioned and secretions removed. Also, as the patient is going off to sleep, suction needs to be available in the event the patient should vomit. In practice, the anesthesia nurse will stand at the head of the operating room table adjacent the patient's head for manipulation of the suction catheter. The nurse will frequently place the suction catheter off to the side near the anesthesia machine after one suctioning event. Usually this procedure is repeated a few times before the breathing tube is removed. Very often the catheter, which is attached to long tubing that empties into a container, falls to the floor, the reasons for which will now be described.

Emerging the patient from general anesthesia is a critical moment because this is the time that a decision is made by the CRNA or MDA (anesthesiologist) as to when the breathing tube can be removed (extubation) and the patient will now be able to breathe on his own. Patients frequently emerge "wild and restless" (second stage of anesthesia or the stage of excitement when the patient is still considered anesthetized) and they are now aware of the tube in their throat and they do not like it. Usually an attempt is made to get their hands on the tube and remove it. If the tube is removed prematurely; 1) the patient can stop breathing and the tube would need to be reinserted emergently; 2) secretions or vomitus may slip down the trachea into the lungs causing an asperation pneumonia. If the catheter is now on the floor contaminated, the anesthesia personnel usually lose sight of the patient because it is necessary for them to quickly turn away to obtain another sterile catheter. It is at this time that one should not lose sight of the patient.

SUMMARY OF THE INVENTION

It is an object of the invention to provide apparatus for supporting the suction catheter adjacent the head of a patient on an operating room table so that it will be ready for use by anesthesia personnel.

In accordance with one aspect of the present invention there is provided apparatus for use with a patient on an operating room table in connection with an anesthesia machine. The apparatus comprises a support member for suction tubing and a catheter, means for clamping the support member to the operating room table and a passageway through the support member for receiving one end of the suction tubing. A catheter is provided having one end for insertion in the patient's mouth and the other end for connection to one end of the suction tubing. Connection means is provided with the one end of the suction tubing for preventing the catheter from passing through the passageway. The passageway is constructed and arranged so that the tubing can be pulled up through the support member to permit the catheter to reach the mouth of the patient and when released will slide back down and stop at the catheter so as to be readily available for re-use. In accordance with a further aspect of the invention a clamp is carried by the support member for clamping and unclamping the suction tubing for controlling the suction through the suction tubing to the catheter. The support member preferably has a portion thereof shaped to receive a bar on the operating room table and the means for clamping the support member to the operating room table comprises a screw member threadedly carried by the support member and having one end adapted to engage the bar. The passageway through the support member includes wall structure providing low friction with respect to the suction tubing to be pulled therethrough. The passageway through the support member preferably includes a tubular sleeve having an inner surface providing low friction with respect to the suction tubing when pulled therethrough.

BRIEF DESCRIPTION OF THE DRAWINGS

FIG. 1 is a fractional perspective view showing the head end of an operating room table with the apparatus embodying the present invention attached thereto.

FIG. 2 is a sectional view taken along the lines 2—2 in FIG. 1 showing the support member for the suction tubing attached to the bar on the operating room table.

DESCRIPTION OF THE PREFERRED EMBODIMENT

Referring to FIG. 1 there is illustrated a partial view of an operating room table 10 taken from the head end. The anesthesia personnel P would stand at the head end as indicated in FIG. 1. The opposite sides of the operating table preferably are provided with suitable bars 11 and 12 where arm boards, (not shown) are usually attached. A canister or container 13 is preferably mounted on the operating room wall and associated with a source of suction, not shown.

In accordance with the present invention an adaptor or support member 14 is mounted on one of the bars of the operating room table such as bar 11. It will be noted in FIG. 1 that the support member 14 is mounted on the bar 11 at a location adjacent the head end of the table where it is readily accessible by the anesthesia personnel P. The support member 14 is shaped so that it may be readily clamped or attached to the bar 11. As may be seen in FIG. 2 the support member 14 is preferably provided with a U-shaped section at one side thereof which is adapted to receive the bar 11. The U shaped section includes a pair of spaced arms **14*a*, 14*b* with arm 14*a* having a threaded opening therethrough adapted to receive a threaded screw member 15. By tightening the screw member 15 the adaptor or support member 14 will be tightly clamped to the bar 11**.

The support member 14 is also provided with a passageway **14*c* extending therethrough for receiving one end of a suction tubing 16. This end of the suction tubing 16 is connected to a catheter 17 having a free end for insertion in the patient's mouth. The other end of the suction tubing is connected to the suction canister 13** for discharge therein.

As shown in FIG. 2 there is a connector 18 which connects the inlet end of the suction tubing 16 with the adjacent end of the catheter 17. The connector 18 includes an extension **18*a* at one end for being received within the inlet end of the suction tubing 16 and an extension 18*b* at the opposite end for being received within the discharge end of the catheter 17. Intermediate the extensions 18***a* and 18*b* is a flange 18*c* which has a diameter larger than the passageway 14*c* through the adaptor or support member 14. This is to prevent the end of the suction tube 16 and catheter 17 from passing through the passageway 14*c* when the catheter 17 is released by the anesthesia personnel.

The passageway 14*c* through the support member 14 includes wall structure providing low friction with respect to the suction tubing 16 which is to be pulled therethrough. The support member 14 may be made of metal or suitable plastic material. Depending upon the type of material used for the support member 14 it may be desirable to provide the passageway 14*c* with a tubular sleeve 19 having an inner surface providing low friction with respect to the suction tubing 16. This can be accomplished by providing the interior of the tubular sleeve 19 with a polished inner surface. The sleeve 19 may be metal or it may be of a suitable plastic material such as polytetrafluoroethylene or equivalent which has a low friction surface. Other forms of anti-friction means may be used in the passageway 14*c* such for example as a series of rollers which may be spring biased to keep them in contact with the suction tubing 16.

In operation, the adaptor 14 is first attached to the bar 11 on the operating room table 19. The free end of the suction tubing 16 is inserted through the passageway 14*c* in the adaptor 14 where the free end is placed o the longitudinal extension 18*a* of the connector 18. The opposite extension 18*b* is connected with the catheter 17. The flange 18*c* on the connector 18 is then permitted to rest against the adjacent surface of the adaptor 14 until ready for use by the anesthesia personnel. When in use the anesthesia personnel will pull the suction tubing 16 up through the adaptor passageway 14*c* in the adaptor 14 so that the free end of the catheter 17 can reach the mouth of the patient. When released by the anesthesia personnel, the suction tubing 16 will slide back down and stop at the catheter due to the flange 18*c* on the connector 18 engaging the adaptor 14. The catheter 17 will then be readily available for re-use, as needed, by the anesthesia personnel.

When the catheter 17 is not in use, it is desirable to stop the suction through the suction tubing 16 so as to eliminate the "hissing" noise produced by the suction. In order to accomplish this the support 14 has attached thereto by way of a chain or other flexible member 20 a clamp 21 which is adapted to clamp the tubing 16 thus cutting off the section to the catheter 17. This eliminates the need for the anesthesia personnel from moving away from the patient towards the wall to shut the suction off. This clamping technique can be controlled right at the bedside where there is no need to leave the patient.

From the foregoing it will be seen that the present invention solves a problem that has long existed in operating rooms. It enables the anesthesia personnel to keep the patient constantly in view and avoids the necessity of replacing a suction catheter during an operation.

While a preferred embodiment of the invention has been described and illustrated, it is to be understood that further modifications thereof may be made within the scope of the appended claims without departing from the spirit of the invention.

What is claimed is:

1. Apparatus for use with a patient on an operating from table in connection with an anesthesia machine comprising a support member for suction tubing and a catheter, means for clamping said support member to the operating room table, a passageway through said support member for receiving one end of the suction tubing to be connected to the catheter, the catheter having one end for insertion in the patient's mouth and the other end for connection to the one end of the suction tubing, and means connected with the one end of the suction tubing and the other end of the catheter for preventing the catheter from passing through said passageway, said passageway being constructed and arranged so that the tubing can be pulled up through said support member to permit the catheter to reach the mouth of the patient and when released will slide back down and stop at the catheter so as to be readily available for re-use.

2. Apparatus according to claim 1 including means carried by said support member for clamping and unclamping the suction tubing for controlling the suction through the suction tubing to the catheter.

3. Apparatus according to claim 1 wherein said support member has a portion thereof shaped to receive a bar on the operating room table and said means for clamping said support member to the operating room table comprises a screw member threadedly carried by said support member and having one end adapted to engage the bar.

4. Apparatus according to claim 1 wherein said passageway through said support member includes wall structure providing low friction with respect to the suction tubing to be pulled therethrough.

5. Apparatus according to claim 1 wherein said passageway through said support member includes a tubular sleeve having an inner surface providing low friction with respect to the suction tubing when pulled therethrough.

6. Apparatus according to claim 1 wherein the passageway through said support member includes anti-friction means for engaging the suction tubing when it is pulled therethrough.

7. Apparatus according to claim 6 wherein said anti-friction means comprises a surface of polytetrafluoroethylene.

8. Apparatus according to claim 5 wherein said tubular sleeve is metal.

9. Apparatus according to claim 5 wherein said tubular sleeve includes polytetrafluoroethylene.

10. Apparatus according to claim 1 wherein said means connected with the one end of the suction tubing and the other end of the catheter comprises a connector having an extension at one end for being received by the one end of the suction tubing and an extension at the opposite end of the connector for being received by the other end of the catheter, and projecting structure on said connector intermediate said extensions having a diameter larger than the passageway through said support member to prevent said connector and the catheter from passing through the passageway when the catheter is released.

* * * * *

UNITED STATES PATENT AND TRADEMARK OFFICE

CERTIFICATE OF CORRECTION

PATENT NO. : 5,160,106

DATED : November 3, 1992

INVENTOR(S) : Michelle M. Monick

It is certified that error appears in the above-identified patent and that said Letters Patent is hereby corrected as shown below:

Col. 4, line 3, change "from" to --room--.

Signed and Sealed this

Second Day of November, 1993

*Attest:*

*Attesting Officer*

BRUCE LEHMAN

*Commissioner of Patents and Trademarks*